United States Patent [19]

Rayner

[11] Patent Number: 4,848,677

[45] Date of Patent: Jul. 18, 1989

[54] COMMINUTION/RECOVERY ORE MILL

[75] Inventor: Martin Rayner, Blackheath, Australia

[73] Assignee: Illabo Mining Equipment Company, Sydney, Australia

[21] Appl. No.: 264,528

[22] Filed: Oct. 31, 1988

[30] Foreign Application Priority Data

Oct. 30, 1987 [AU] Australia ..... PI5162

[51] Int. Cl.[4] ..... B02C 13/288

[52] U.S. Cl. ..... 241/40; 241/55; 241/79.1; 241/152 A; 241/189 R; 241/284; 241/285 B

[58] Field of Search ..... 241/189 R, 275, 79.1, 241/152 A, 285 R, 300, 285 A, 55, 285 B, 5, 188 R, 39, 284

[56] References Cited

U.S. PATENT DOCUMENTS

| | | | |
|---|---|---|---|
| 1,570,037 | 1/1926 | Blum et al. | 241/189 R X |
| 1,608,183 | 11/1926 | Quante | 241/55 |
| 1,807,923 | 6/1931 | Lykken | 241/189 R X |
| 2,546,286 | 3/1951 | Zakel | 241/55 X |
| 2,931,581 | 4/1960 | Lykken et al. | 241/189 R X |
| 3,333,777 | 8/1967 | Highfill et al. | 241/189 R X |
| 3,756,519 | 9/1973 | Reynolds et al. | 241/189 R X |

FOREIGN PATENT DOCUMENTS 1329818 8/1987 U.S.S.R. ..... 241/189 R

*Primary Examiner*—Mark Rosenbaum

*Attorney, Agent, or Firm*—Frelich Hornbaker Rosen & Fernandez

[57] ABSTRACT

A mill for comminution and separation of lump ore and subsequent recovery of relatively dense components of the ore, said mill including a stationary housing defining an ore reduction chamber therewithin, an impactor rotor drum rotatably mounted within said housing, said rotor drum supporting a plurality of circumferentially spaced ore breaker hammers and fixedly supporting a plurality of vanes for directing a high velocity air stream around said ore reduction chamber and defining a central feed region therewithin for receiving said lump ore, a plurality of transverse ore breaker plates fixedly supported within said housing and radially spaced from said rotor drum, an autogenous region in downstream communication with said ore reduction chamber, said autogenous region including a high velocity venturi region, a low velocity expansion region downstream of said venturi region and at least one collector plate arranged such that in use a particle laden air stream is directed through said venturi region and out into said expansion region where further particle comminution occurs and relatively dense particles precipitate and are retained on said collector plate.

18 Claims, 5 Drawing Sheets

COMMINUTION/RECOVERY ORE MILL

The present invention relates to mills for the comminution and separation of lump ore and in particular to a mill for the conversion of dry lump ore to a predetermined classification and the subsequent gravity concentration of the more dense components of the ore.

The invention has been developed primarily to recover gold from its ore and will be described hereinafter with reference to this application. However, it will be appreciated that the invention is not limited to this particular field of use.

In the past, the separation of gold from its ores has required a series of separate staged operations including crushing and classifying the ore and subsequent concentration and removal of the heavier gold particles interspersed therewithin. Furthermore, known mills involve additional problems of excessive hammer wear, and clogging.

It is an object of the present invention to provide a mill which overcomes or substantially ameliorates at least some of these disadvantages.

According to the invention there is provided a mill for comminution and separation of lump ore and subsequent recovery of relatively dense components of the ore, said mill including a stationary housing defining an ore reduction chamber therewithin, an impactor rotor drum rotatably mounted within said housing, said rotor drum supporting a plurality of circumferentially spaced ore breaker hammers and fixedly supporting a plurality of vanes for directing a high velocity air stream around said ore reduction chamber and defining a central feed region therewithin for receiving said lump ore, a plurality of transverse ore breaker plates fixedly supported within said housing and radially spaced from said rotor drum, an autogenous region in downstream communication with said ore reduction chamber, said autogenous region including a high velocity venturi region, a low velocity expansion region downstream of said venturi region and at least one collector plate arranged such that in use a particle laden air stream is directed through said venturi region and out into said expansion region where autogenous particle comminution occurs and relatively dense particles precipitate and are retained on said collector plate.

Preferably the ore breaker hammers are elongate and are swingably and releasably supported by the rotor drum. Two discrete pairs of adjacent hammers sharing respective common support shafts are preferably circumferentially spaced 180 degrees apart on the rotor drum.

Preferably also the autogenous region includes a streamlined airfoil formation for inducing a low pressure region therebeneath to induce further precipitation of relatively heavy particles from said particle laden air stream.

A preferred embodiment of the invention will now be described, by way of example only, with reference to the accompanying drawings in which.

Figure 1:
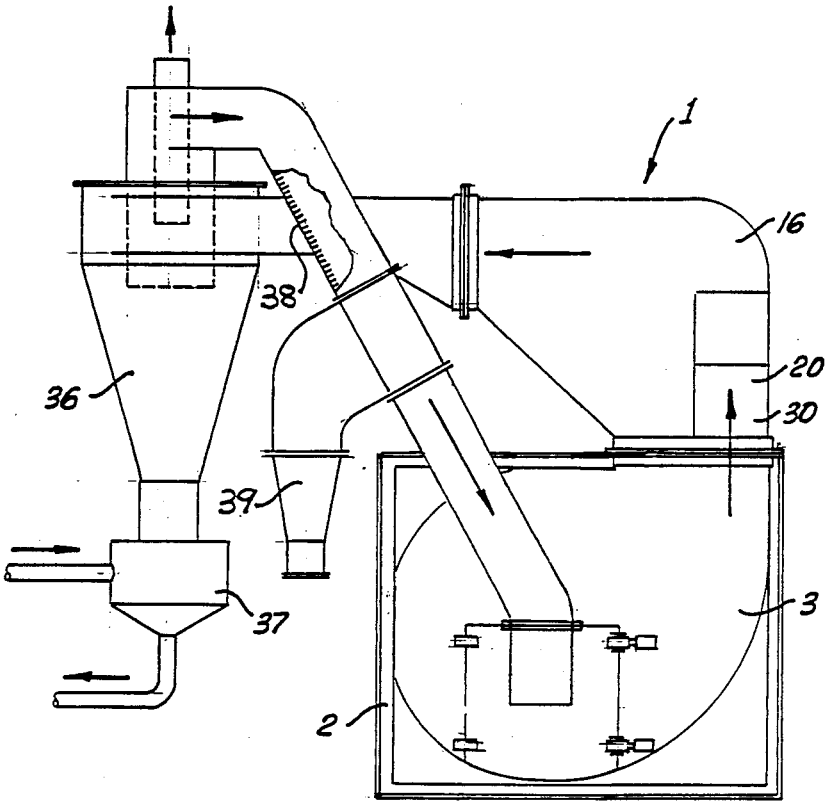
FIG. 1 is a front elevation of a mill and associated cyclone separator and ducting according to the invention.

Referring to the drawings, a mill 1 for refining lump ore (not shown) includes a stationary housing 2 defining an ore reduction chamber 3 therewithin.

An impactor rotor drum 4 is rotatably mounted within the housing 2 and adapted to be driven about a horizontal axis 5 by a rotary power source (not shown). The rotor drum 4 swingably and releasably supports two pairs 6 and 7 of adjacent elongate ore breaker hammers 8. The pairs 6 and 7 of hammers 8 are supported on shafts 9 which are circumferentially spaced 180 degrees apart on rotor drum 4. The hammers 8 of each pair are spaced in fixed axial relation by means of a central spacer bush (not shown) so as to be swingably retained adjacent respective rotor drum side walls. The rotor drum also fixedly supports a plurality of impellor vanes 10 and ore thrower blades 11 extending radially outwardly for directing a high velocity composite stream of ore fragments and air around the ore reduction chamber 3. The impellor vanes 10 are radially shorter than the ore thrower blades 11 to prevent the vanes 10 from being excessively damaged or worn by directly striking the ore fragments.

Figure 4:
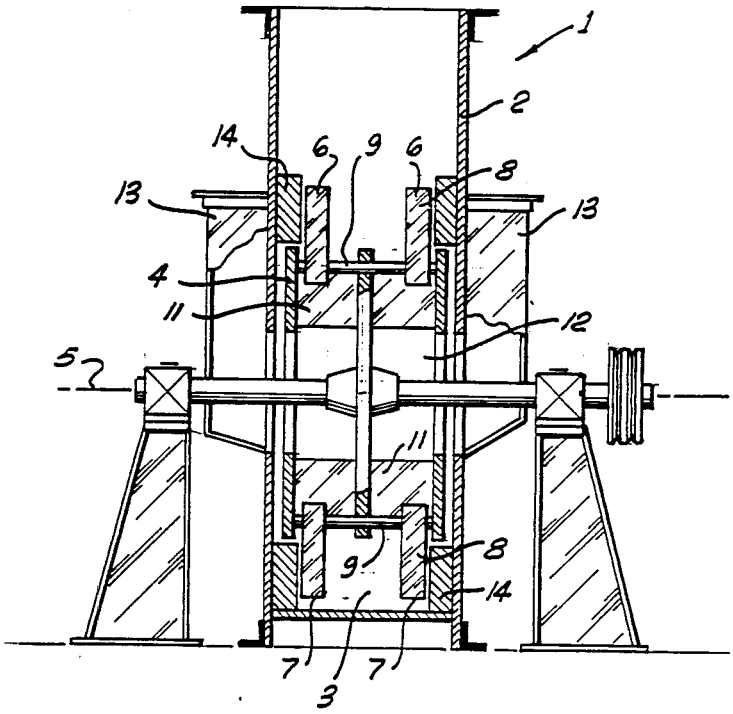
FIG. 4 is an end elevation of a mill having twin mutually opposed feed chutes according to a second embodiment of the invention.

The rotor drum 4 defines a central feed region 12 therewithin for receiving the lump ore via an inflow feed chute 13. In an alternative embodiment, the central feed region 12 receives lump ore from both sides via twin mutually opposed inflow feed chutes 13 as shown in FIG. 4.

Figure 3:
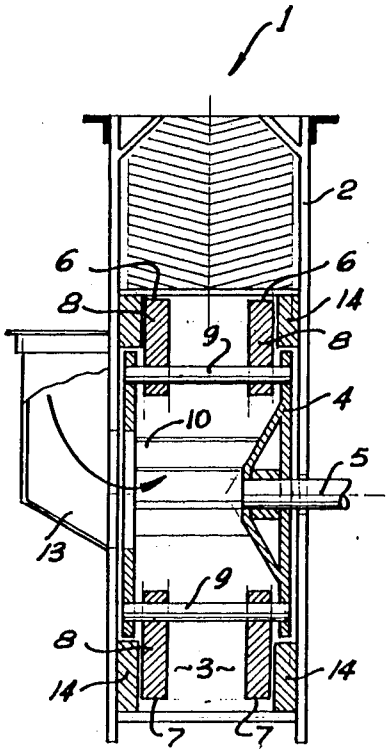
FIG. 3 is a sectional view taken along line 3—3 of FIG. 2.
Figure 2:
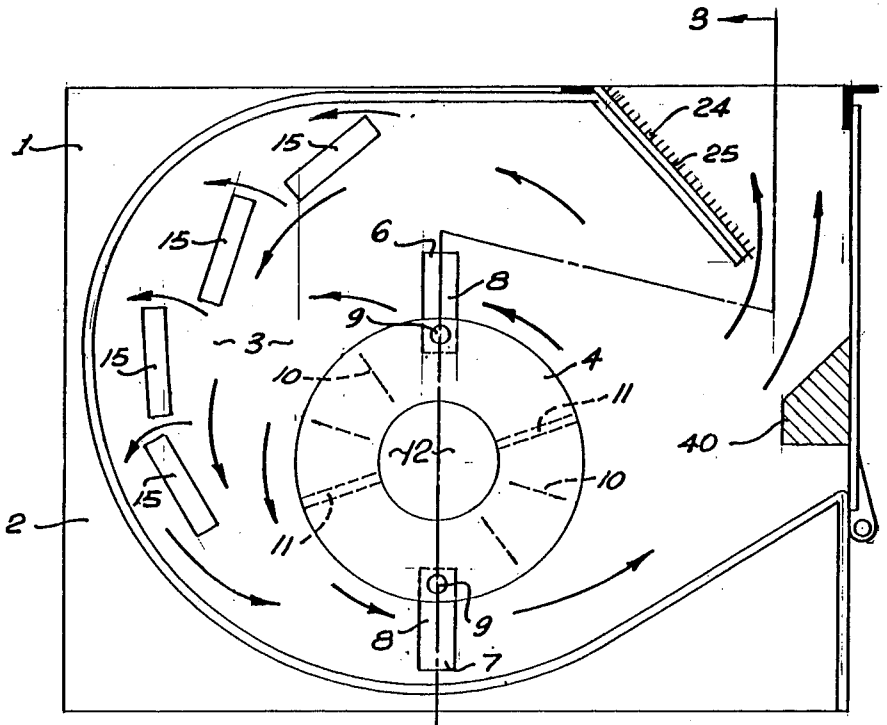
FIG. 2 is a cutaway front elevation of part of the mill of FIG. 1 showing ore reduction chamber, rotor drum and ore breaker plates according to the invention.

Removable annular wear plates 14 are attached to the inside walls of the housing 2 adjacent the rotor drum 4 to be periodically replaced as wear occurs in the ore reduction chamber. As best seen in FIGS. 3 and 4, the wear plates 14 extend circumferentially around the rotor drum such that the inner surfaces of the wear plates are substantially flush with the inner surfaces of the respective rotor drum side walls. The hammers 8 are spaced on the shafts 9 such that minimal clearance is maintained between the hammers and adjacent wear plates.

A plurality of inwardly directed substantially flat ore breaker plates 15 are fixedly supported within the housing 2 and radially spaced from the rotor drum for shattering the ore fragments impacting thereon. The inner faces of the ore breaker plates are substantially perpendicular to respective tangents extending circumferentially from the rotor drum to ensure that the impacting ore fragments strike the plates at right angles.

An exhaust flue 16 in downstream communication with the ore reduction chamber 3 defines an autogenous region 17 therewithin. The autogenous region 17 includes inwardly depending constricting intrusions 18 defining a high velocity venturi region 19 and outwardly diverging sidewalls 20 defining a low velocity expansion region 21 downstream of the venturi region. The autogenous region 17 further includes collector plates 24 having parallel transverse collector riffles 25 for retaining the relatively more dense particles precipitating out of the particle laden air stream 26 in the autogenous region.

The stationary housing 2 further includes a removable grid 40 projecting inwardly into the ore reduction chamber to prevent coarse ore fragments from being flung upwardly into the autogenous region.

A streamlined airfoil formation 27 is supported downstream from the autogenous region 17 for diverting the particle laden airstream 26 around the exhaust flue 16 an inducing a turbulent low pressure region therebeneath to cause further precipitation of the heavy gold particles from the stream. A selectively adjustable hinged flap 28 is supported in the downstream portion of the flue 16 to facilitate regulation of flow rate and pressure within the autogenous region.

Angled intrusions 29 project into the upper portion of the expansion region 21 to define baffles for diverting the rising air stream downwardly and induce turbulent swirl to enhance comminution within the autogenous region. The intrusions 29 are height adjustable to facilitate optimisation of autogenous comminution within the autogenous region.

Hinged doors 30 having integral collector plates 24 open outwardly to provide access to the autogenous region 17 and the collector plates 24 to facilitate removal of the heavier gold particles retained on the collector plates by the collector riffles.

Figure 7:
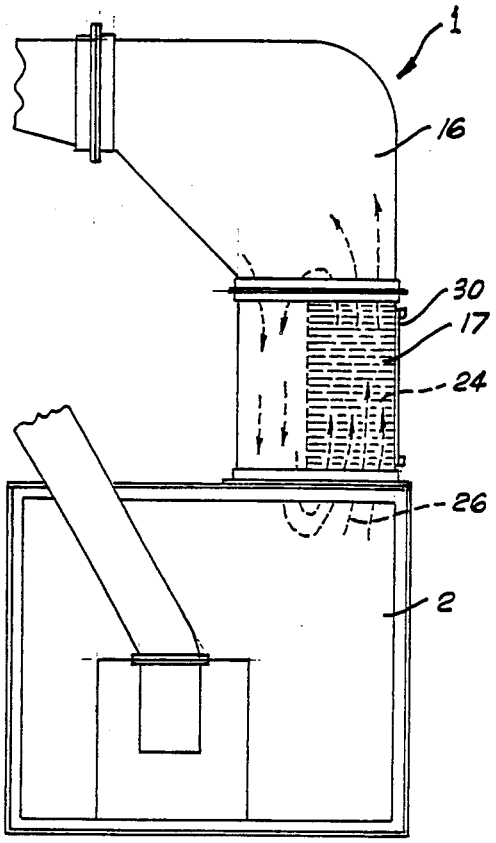
FIG. 7 is a front elevation of a mill having separate autogenous region and exhaust flue modules according to an alternative embodiment of the invention.

An alternative embodiment of the invention is shown in FIG. 7 in which the autogenous region 17 and exhaust flue 16 consist in discrete interchangeable modules which can be individually tailored to optimise autogenous communition of specific types of ores and to retain particles of specific classifications.

Turning now to describe the operation of the mill, lump ore is continuously fed into the central feed region 12 via the inflow feed chute 13. The rotation of the rotor drum ore thrower blades 11 flings the ore outwardly into the ore reduction chamber 3 and against the ore breaker plates 15 where the ore fragments are shattered on impact. The ore fragments are then further smashed by the rotating ore breaker hammers 8, and swept around the ore reduction chamber.

When the ore particles are sufficiently small they are swept upwards by the high velocity air stream 26 generated by the impellor vanes 10 and thrower blades 11, through high velocity venturi region 19 and downstream into the low velocity expansion region 21.

Figures 5, 6:
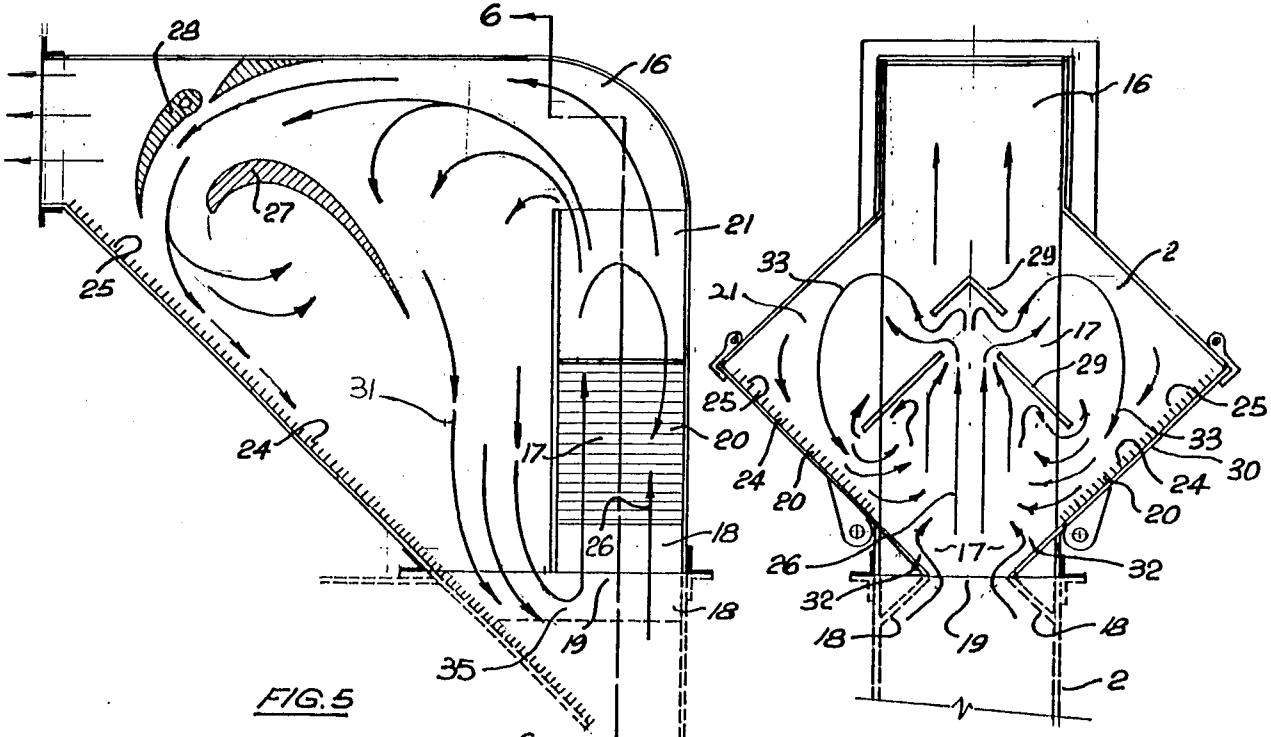
FIG. 5 is a sectional front elevation of the exhaust flue showing the autogenous region, airfoil formation and collector plates according to the invention.
FIG. 6 is a sectional view taken along line 6—6 of FIG. 5 showing the venturi region, expansion region and collector plates.

The particle laden stream diverges outwardly from the venturi throat and is drawn around into the low pressure zones 32 in a circulatory manner as represented by streamlines 33 in FIG. 6. The circulating low velocity streams then converge with the high velocity low pressure incoming stream 26 resulting in autogenous comminution as the particles from the intersecting streams collide in the autogenous region 17 and are further reduced. Similarly, autogenous comminution occurs in region 35 where the two streams 26 and 31 converge.

In the regions where the converging streams intersect and in regions of swirl and turbulence, the collision of airborne particles causes the heavier gold particles to precipitate out from the stream. These particles are retained on the collector plates from where they can be periodically removed via hinged doors 30.

The stream leaving the autogenous region is ducted to a cyclone separator 36 where the lighter particles are separated and mixed with water in a mixing bucket 37 to form a slurry, which may undergo further separation processes to extract any residual gold powder.

The return flow from the cyclone separator 36 is ducted back into the central feed region 12 to increase air flow through the mill and reduce the level of airborne dust released into the atmosphere. A fine gold trap 38 and filter 39 may be incorporated into the cyclone return duct to collect finer residual gold dust and clean the return air being recycled to the mill.

This mill experiences minimal hammer wear, and does not experience the problem of clogging often associated with known mills if overfed. The mill crushes and classifies the lump ore and concentrates the gold particles for periodic removal in a continuous process without the need for screens or grates.

Although the invention has been described with reference to specific examples, it will be appreciated by those skilled in the art that the invention may be embodied in many other forms.

I claim:

1. A mill for comminution and separation of lump ore and subsequent recovery of relatively dense components of the ore, said mill including a stationary housing defining an ore reduction chamber therewithin, an impactor rotor drum rotatably mounted within said housing, said rotor drum supporting a plurality of circumferentially spaced ore breaker hammers and fixedly supporting a plurality of vanes for directing a high velocity air stream around said ore reduction chamber and defining a central feed region therewithin for receiving said lump ore, a plurality of transverse ore breaker plates fixedly supported within said housing and radially spaced from said rotor drum, an autogenous region in downstream communication with said ore reduction chamber, said autogenous region including a high velocity venturi region, a low velocity expansion region downstream of said venturi region and at least one collector plate arranged such that in use a particle laden air stream is directed through said venturi region and out into said expansion region where further particle comminution occurs and relatively dense particles precipitate and are retained on said collector plate.

2. A mill according to claim 1 wherein said rotor drum swingably and releasably supports a plurality of elongate ore breaker hammers.

3. A mill according to claim 1 wherein two pairs of adjacent ore breaker hammers are circumferentially spaced 180 degrees apart on said rotor drum.

4. A mill according to claim 1 wherein said rotor drum is adapted to be rotatably driven about a horizontal axis.

5. A mill according to claim 1 wherein said rotor drum central feed region is adapted to receive said lump ore from both sides.

6. A mill according to claim 1 wherein said transverse ore breaker plates are substantially flat and are directed radially inwardly.

7. A mill according to claim 1 wherein said transverse ore breaker plates are substantially flat having central regions perpendicular to respective corresponding tangents projected circumferentially from said rotor drum.

8. A mill according to claim 1 wherein said autogenous region includes a streamlined airfoil formation for inducing a low pressure region therebeneath to induce precipitation of relatively heavy particles from said particle laden air stream.

9. A mill according to claim 1 wherein said collector plate includes a plurality of parallel transverse collector riffles to retain said relatively dense particles.

10. A mill according to claim 1 wherein a selectively adjustable hinged flap is supported downstream of said autogenous region to facilitate selective regulation of flow within said autogenous region.

11. A mill according to claim 1 wherein said autogenous region is defined by an exhaust flue.

12. A mill according to claim 11 wherein said autogenous region and said exhaust flue are constructed in discrete modular form.

13. A mill according to claim 11 wherein side walls of said exhaust flue define said expansion region and have at least one integral collector plate.

14. A mill according to claim 1 wherein said stationary housing includes removable wear plates substantially adjacent said rotor drum.

15. A mill according to claim 1 wherein said venturi region is defined by a pair of elongate substantially parallel intrusions projecting inwardly into said autogenous region.

16. A mill according to claim 1 wherein said expansion region includes at least one baffle for redirecting said particle laden air stream and inducing turbulent swirl to enhance comminution within said autogenous region.

17. A mill according to claim 16 wherein said baffle is selectively height adjustable.

18. A mill according to claim 1 wherein a cyclone separator is provided downstream of said autogenous region for removing relatively less dense particular components from said particle laden airstream.

* * * * *